United States Patent [19]

Bochan

[11] 3,977,219

[45] Aug. 31, 1976

[54] LINT FILTER FOR AUTOMATIC WASHER

[75] Inventor: John Bochan, Louisville, Ky.

[73] Assignee: General Electric Company, Louisville, Ky.

[22] Filed: Sept. 15, 1975

[21] Appl. No.: 613,478

[52] U.S. Cl. ..... 68/18 F; 210/411; 210/474; 210/477

[51] Int. Cl.[2] ..... D06F 39/10

[58] Field of Search ..... 68/18 R, 18 F, 18 FA; 134/110, 111; 210/474, 477, 411, 167

[56] References Cited

UNITED STATES PATENTS

| | | | |
|---|---|---|---|
| 2,972,876 | 2/1961 | Geldhof | 68/18 F |
| 3,219,192 | 11/1965 | Trembath et al. | 210/167 X |
| 3,331,225 | 7/1967 | McCombs | 68/18 F |
| 3,466,901 | 9/1969 | Reid | 68/18 F |
| 3,896,641 | 7/1975 | Worst | 68/18 F X |

*Primary Examiner*—Philip R. Coe
*Attorney, Agent, or Firm*—Frederick P. Weidner; Francis H. Boos

[57] ABSTRACT

A lint filter for an automatic washing machine having a rotatable walled basket for receiving items to be washed and means for recirculating liquid therein. The lint filter comprises an annulus channel member having an inside wall, an outside wall, and perforations for liquid to pass therethrough. The annulus channel member is secured to the wall of the basket inwardly thereof. There is provided a plurality of elongated protuberances attached to the inside wall of the annulus channel member with their bases positioned toward the rotational axis of the basket such that during rotation of the basket lint will be removed from the protuberances by centrifugal force.

12 Claims, 5 Drawing Figures

LINT FILTER FOR AUTOMATIC WASHER

BACKGROUND OF THE INVENTION

1. Field of the Invention:

The present invention relates to an automatic clothes washing machine, and, in particular, to a lint filter for use in an automatic washing machine.

2. Description of the Prior Art:

It is desirable, in an automatic washing machine, to provide means for the removal of lint from the liquid being recirculated within the machine. To this end, various lint filter devices have been utilized in the past.

The prior art teaches the use of pin or bristle type filtering elements placed in the recirculation flow of an automatic washing machine. Cleaning of such filtering elements, however, has been accomplished by removing the entire filter from the machine and picking the lint off the pins or bristles and backflushing the filter under a household faucet to dislodge the lint and remove it from the filter. This is a laborious but necessary task if the filter is to continue functioning properly.

It is therefore an object of the present invention to provide a lint filter of the bristle type for an automatic washing machine which entraps lint from the recirculation water and then provides for automatically cleaning the entrapped lint from the lint filter.

SUMMARY OF THE INVENTION

In accordance with the present invention, a lint filter is provided for a washing machine having a rotatable walled basket for receiving items to be washed and means for recirculating liquid therein. Included is an annulus channel member having an inside wall, an outside wall, and perforations for recirculating liquid to pass therethrough. The annulus channel member is secured to the wall of the basket inwardly thereof for rotation therewith. There is provided a plurality of elongated protuberances attached to the inside wall of the annulus channel member with the bases of the protuberances positioned toward the rotational axis of the basket such that during rotation of the basket lint will be removed from the protuberances by centrifugal force.

DESCRIPTION OF THE PREFERRED EMBODIMENT

Figure 1:
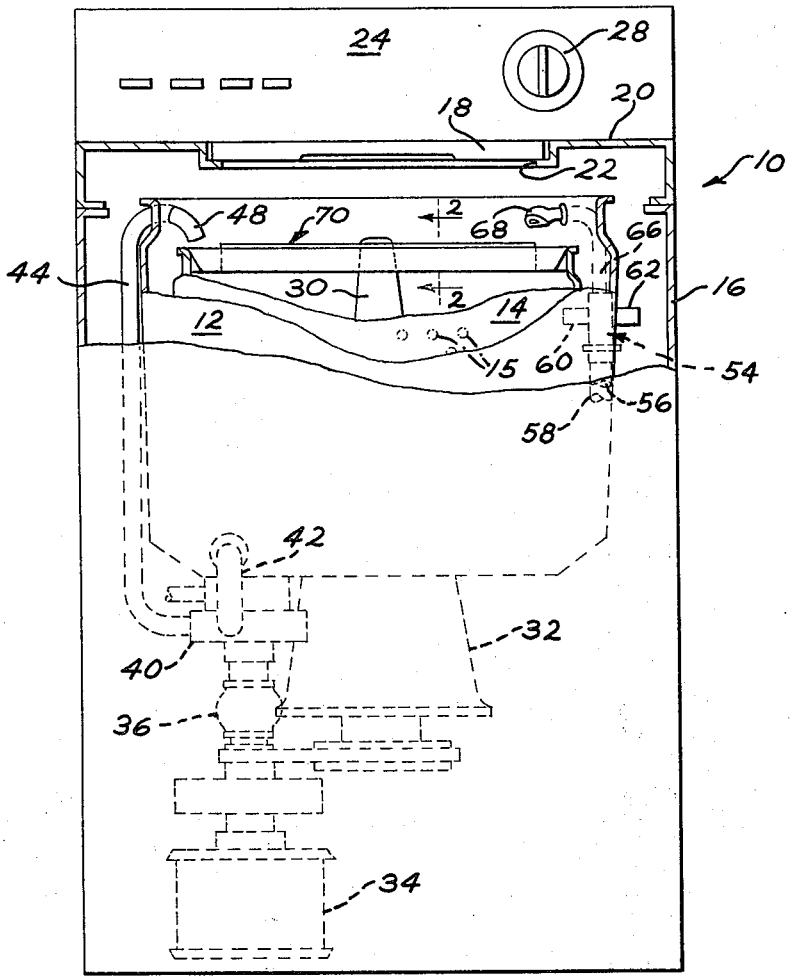
FIG. 1 is a front elevational view, with portions broken away, of an automatic washing machine of the vertical axis type incorporating a preferred embodiment of the present invention.

Referring to FIG. 1, there is shown a vertical agitator type automatic clothes washing machine 10 for receiving items to be washed and including outer tub 12, an imperforate structure, and, suitably mounted therein, a rotatable walled clothes-containing basket 14 for receiving the soiled clothes to be washed. The basket 14 has its side and bottom walls provided with perforations 15. Tub 12 then serves as a liquid receptacle, the basket 14 and tub 12 together serving, in effect, as a container means for the clothes and the liquid in which they are to be washed and rinsed.

Tub 12 is rigidly mounted within an appearance cabinet 16, which includes a cover 18 hingedly mounted upon a removable top portion 20 of the cabinet. When cover 18 is lifted, it provides access through an opening 22 to the basket 14. The rigid mounting of tub 12 within cabinet 16 may be effected by any suitable means.

At the center of basket 14, there is positioned a vertical axis agitator 30 which includes a plurality of water circulating vanes (not shown) joined at their lower ends by an outwardly flared skirt (also not shown). Both the clothes basket 14 and the agitator 30 are rotatably mounted. Rotational drive is translated to basket 14 and agitator 30 through a transmission 32 driven by an electric motor 34 connected thereto by suitable drive mechanism means. The agitator 30 is also mounted for oscillatory rotation during certain cycles of the washing operation. Details of constructional operation of such an automatic washing machine are fully disclosed in U.S. Pat. No. 3,248,912–Bochan, assigned to the same assignee as the present invention. Mounted on the cabinet top 20 is a control panel 24 including sequence control means such as a cycle controlling timer device 28 which serves to conduct the washing machine 10 through various washing cycles which may be selected by the operator.

During one cycle of operation of the washer 10, fabrics, detergent and a predetermined quantity of liquid are introduced into the tub 12 and basket 14, and the agitator is then oscillated back and forth about its axis to move the clothes within the basket. During this operation, the wash liquid is being recirculated. After a predetermined period of this washing action, the agitator 30 and basket 14 are rotated in unison at high speed to centrifugally extract the washing liquid from the fabrics and discharge it to drain. Following this extraction operation, a supply of clean liquid is introduced into the tub 12 and basket 14 for rinsing of the fabrics and the agitator 30 is again oscillated. Finally, the agitator 30 and basket 14 are once more rotated in unison at high speed to extract the rinse liquid.

In addition to operating transmission 32, motor 34 also provides a direct drive through a flexible coupling 36 to liquid-recirculating means such as the pump structure generally indicated at 40. Pump 40 has an inlet connected by a conduit 42 to the interior of tub 12 and an outlet connected by a conduit 44 to a nozzle 48. With such a structure, when the motor 34 is rotating so as to provide agitation, pump 40 draws liquid through conduit 42 from tub 12 and discharges it via conduit 44 through nozzle 48. Operation of this recirculation system will be discussed further herein.

Liquid supply means including valve assembly 54 is adapted to supply hot and cold water to the machine, the valve being connected respectively to hot and cold water sources, such as household faucets (not shown), by a pair of conduits 56 and 58. Valve 54 may be provided with a pair of solenoids 60 and 62 such that the energization of solenoid 60 permits passage of hot water through the valve, and energization of solenoid 62 permits passage of cold water through the valve; likewise, energization of both solenoids permits mixing of hot and cold water in the valve and passage of warm water therefrom through an outlet conduit 66 extending from the valve 54. Outlet conduit 66 communicates with a nozzle 68 which is positioned to discharge into basket 14.

In accordance with the present invention, there is provided a lint filter, generally shown by the numeral 70. Filter 70 has been arranged such that the flow of recirculating water emerging via outlet conduit 44 from nozzle 48 will flow through the filter and back into the basket 14. That flow of water, initially coming from tub 12 through inlet conduit 42, should be filtered before passing back into the basket 14 to remove lint and other foreign materials that may have been picked up or that may have been separated from the items of clothing being washed in the machine. Filter 70 then performs the function of entrapping lint or other foreign material before the recirculating water passes back into basket 14.

Figure 2:
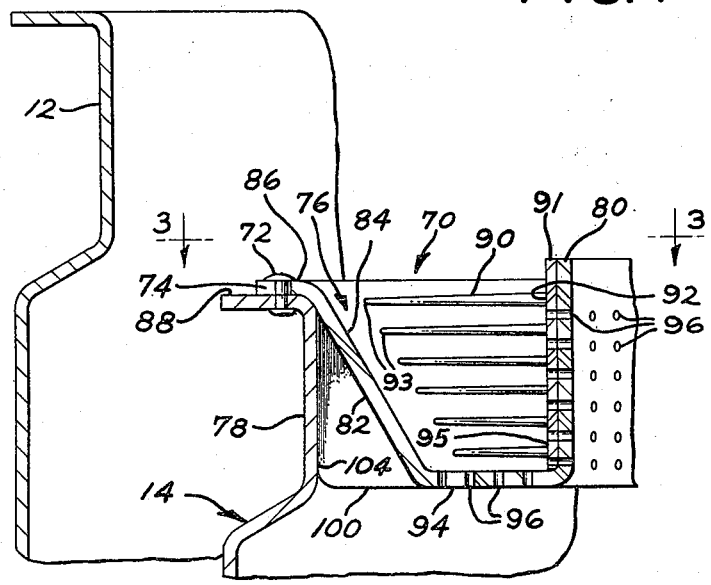
FIG. 2 is a view taken generally along lines 2—2 of FIG. 1 and enlarged to better show the details of the lint filter.
Figure 3:
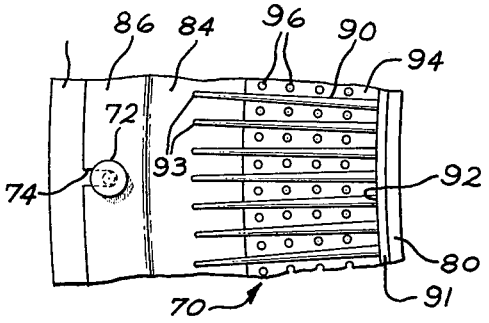
FIG. 3 is a view taken generally along lines 3—3 of FIG. 2.

Referring now to FIGS. 2 and 3 particularly, filter 70 is shown as being suitably attached to the wall of the basket 14 inwardly and near the top thereof, so that liquid passing through the lint filter during oscillatory rotation of the agitator when the liquid is being recirculated passes into basket 14. The attachment may be by any suitable means such as a fastening lug 72 received in a complementary slot 74 at the top edge 88 of the basket wall. Preferably, the attachment means will allow removal of the lint filter from the basket 14 for servicing, if necessary. The lint filter is essentially an annulus channel member 76 which, under most arrangements, would be endless and positioned inwardly and around the periphery of the circular upper wall 78 of the rotatable basket 14. The annulus channel member 76 has an inside wall 80 and an outside wall 82 relative to the axis of rotation of the basket 14. The outside wall 82 is slanted outwardly and upwardly, thus providing a slanted interior surface 84. The outside wall 82 terminates at its upper end in an outwardly directed flange or lip 86 that extends over the edge 88 of the upper wall 78 of the basket 14.

The channel member 76 has attached to its inside wall 80 a plurality of elongated protuberances 90 having bases 92 and terminal ends 93. The protuberances 90 may be in the form of bristles having a diameter essentially the same throughout its length as viewed in vertical cross-section or, preferably, they are tapered as shown in the drawings. The preference for tapering the protuberances 90 will be discussed later. The embodiment shown in FIGS. 2 and 3 has the elongated protuberances 90 secured at their bases 92 to a substrate member 91 which may be attached by any suitable means to the annulus channel member inside wall 80. In this manner, the protuberances 90 and substrate member 91 may be molded integrally from suitable material, such as plastic or elastomeric material in a strip form, then applied or joined to the interior surface 108 of the inside wall 80.

Figure 4:
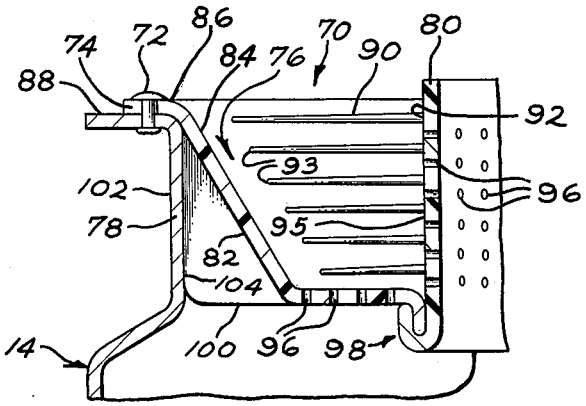
FIG. 4 is an alternate construction of the lint filter of FIGS. 2 and 3.

FIG. 4 shows an alternate construction of the lint filter of FIGS. 2 and 3, wherein the protuberances 90 are secured or attached directly to the inside wall 80. In this construction, the protuberances 90 and the annulus channel member 76 may be molded from suitable plastic, thus allowing the protuberances to be integrally formed with the inside wall 80. The annulus channel member may be molded in two parts, one part containing the outside wall 82 and the other part containing the inside wall and the attached protuberances 90. There is thus provided a joining seam 98 which may be accomplished by any suitable joining operation. To add stability to the attachment of the lint filter to the rotatable walled basket 14, standoff ribs 100 are provided around the periphery of the slanted outside wall 82 and have their outside edge 102 abutting the interior surface 104 of the upper wall 78 of the basket 14.

With reference to FIGS. 2, 3 and 4, the protuberances extend from the inside wall 80 toward the outside wall 82 to essentially span the distance between those walls. However, it is preferable that the terminal ends 93 of the protuberances 90 be spaced somewhat from the outside wall 82 to allow a passageway for flushing the accumulated lint, as will be described subsequently. Because of the slanted surface 84 of the outside wall 82, the protuberances 90, as shown in FIGS. 2, 3 and 4, are of varying length with the longest at the top of the annulus channel member and the shortest at the bottom. While the protuberances 90 are shown in vertical alignment for drawing clarity, preferably they are staggered to provide a greater maze or labyrinth of protuberances 90 to increase their lint trapping or filtering capability. The protuberances 90 are substantially perpendicular to the axis of rotation of the basket 14 during rotation thereof.

The annulus channel member 76 would also have a bottom wall 94 connecting the inside wall 80 and outside wall 82 unless the channel member was V-shaped with the inside and outside walls joined together at their respective bottom edges. There are perforations 96 provided to allow the filtered liquid to pass through the annulus channel member 76 and back into the basket 14. These perforations may be provided in the substrate 91 and inside wall 80, or bottom wall 94, or both. The perforations 96 are arranged and dimensioned to allow good liquid-flow characteristics which will depend somewhat on the recirculation flow rate desired for a particular clothes washer.

Figure 5:
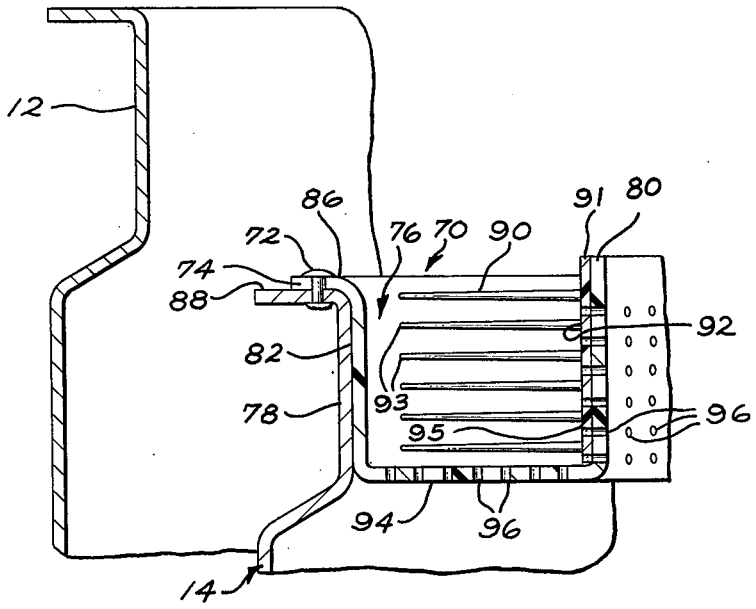
FIG. 5 is an alternate embodiment of the lint filter of FIG. 2.

With reference to FIG. 5, an alternate embodiment of the lint filter is shown. In this case, the annulus channel member 76 is rectangular-shaped in vertical cross-section and has an inside wall 80, an outside wall 82, and a bottom wall 94. Since the channel member is rectangular in shape and does not have the outside wall 82 slanted, as does the embodiment of FIG. 2, the protuberances 90 are all of essentially the same length from their bases 92 to their terminal ends 93. Again, as in the embodiment of FIG. 2, the terminal ends 93 are spaced inwardly of the outside wall 82 to allow the passage of lint during cleaning.

The operation of the lint filter will now be described. Fabrics, detergent and a predetermined quantity of liquid are introduced into the tub 12 and basket 14, and the agitator is then oscillated back and forth about its axis to move the clothes within the basket for the wash operation. During the wash operation, liquid is withdrawn from the tub through conduit 42 by pump 40, then through conduit 44, and re-introduced through nozzle 48 back into the basket 14. Nozzle 48 is directed such that the recirculation liquid is impinged upon a section of the annulus channel member 76 of the lint filter. After a predetermined period of this washing action, the agitator and basket are rotated in unison at high speed to centrifugally extract the washing liquid from the fabrics and discharge it to a drain (not shown). During this high-speed rotation, because the lint filter is attached to the basket 14, the annulus channel member rotates in unison with the basket 14. Centrifugal force exerted upon the annulus channel member by the rotation thereof causes any lint which has been accumulated and caught on the protuberances 90 during the wash operation to be forced outwardly therefrom and be stripped from the protuberances 90 and enter the space between the terminal ends 93 and the outside wall 82. The lint, again being acted upon by centrifugal force, travels up the slanted interior surface 90 and over the lip 86 to be deposited in the tub 12, whereupon it is pumped along with the wash liquid to the drain. The lint filter embodiment shown in FIG. 2 is preferred because of the slanted outside wall 82 which enhances the removal of the lint from the annulus channel member 76 by it being more easily moved upwardly and outwardly along the slanted interior surface 84 until it passes over and into the tub 12. After the high-speed spin operation for extracting the liquid, a supply of clean liquid is introduced into the basket for rinsing the fabrics and the agitator is again oscillated. Finally, the agitator and basket are once more rotated in unison at high speed to extract the rinse liquid. During this final liquid extraction operation, centrifugal force is again applied to the accumulated lint to provide for additional action for removing lint from the protuberances and flush it from the lint filter into the tub 12. It can be seen that with the lint filter of this invention the lint is automatically removed from the lint filter and flushed to drain.

The foregoing is a description of the preferred embodiment of the invention and variations may be made thereto without departing from the true spirit of the invention, as defined by the appended claims.

What is claimed is:

1. In a washing machine having a rotatable walled basket for receiving items to be washed and means for recirculating liquid therein, a lint filter comprising:

a. an annulus channel member having an inside wall, an outside wall, and perforations for liquid to pass therethrough; said annulus channel member being secured to the wall of the basket inwardly thereof; and b. a plurality of elongated protuberances having bases and terminal ends, said protuberances being attached to the inside wall of the annulus channel member with their bases positioned toward the rotational axis of the basket such that during rotation of the basket lint will be removed from the protuberances by centrifugal force.

2. The invention of claim 1 wherein the outside wall of the annulus channel member is sloped upwardly and outwardly.

3. The invention of claim 1 wherein the annulus has a bottom wall connecting the inside and outside walls.

4. The invention of claim 3 wherein the perforations are in the bottom wall.

5. The invention of claim 4 wherein the perforations are also in the inside wall.

6. The invention of claim 1 wherein the perforations are in the inside wall.

7. The invention of claim 1 wherein the annulus channel member extends around the top of the walled basket.

8. The invention of claim 1 wherein the terminal ends of the protuberances are spaced inwardly from the outer wall to allow lint to escape during rotation of the basket.

9. The invention of claim 1 wherein the elongated protuberances are tapered in a direction away from their bases.

10. The invention of claim 1 wherein the elongated protuberances are substantially perpendicular to the axis of rotation of the basket during rotation of the basket.

11. The invention of claim 1 wherein the protuberances and inside wall of the annulus channel member are integrally molded.

12. The invention of claim 1 wherein the protuberances are formed with a strip substrate that is attached to the inside wall of the annulus channel member.

* * * * *